US010920567B2

(12) United States Patent
Sankaran et al.

(10) Patent No.: US 10,920,567 B2
(45) Date of Patent: Feb. 16, 2021

(54) HEALTH MONITORING OF POWER GENERATION ASSEMBLY FOR DOWNHOLE APPLICATIONS

(71) Applicant: HALLIBURTON ENERGY SERVICES, INC., Houston, TX (US)

(72) Inventors: Venkataraman Sankaran, Houston, TX (US); Reena A. Chanpura, Sugarland, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 349 days.

(21) Appl. No.: 15/737,722

(22) PCT Filed: Aug. 5, 2015

(86) PCT No.: PCT/US2015/043861
§ 371 (c)(1),
(2) Date: Dec. 18, 2017

(87) PCT Pub. No.: WO2017/023317
PCT Pub. Date: Feb. 9, 2017

(65) Prior Publication Data

US 2018/0179880 A1 Jun. 28, 2018

(51) Int. Cl.
*E21B 47/00* (2012.01)
*E21B 44/00* (2006.01)
(Continued)

(52) U.S. Cl.
CPC ..... *E21B 47/00* (2013.01); *E21B 12/00* (2013.01); *E21B 12/02* (2013.01);
(Continued)

(58) Field of Classification Search
CPC ..... E21B 47/00; E21B 41/0085
See application file for complete search history.

(56) References Cited

U.S. PATENT DOCUMENTS 6,151,962 A 11/2000 Le et al.
8,825,567 B2 9/2014 Jiang et al.
(Continued)

FOREIGN PATENT DOCUMENTS

CN 102410234 A 4/2012

OTHER PUBLICATIONS

Korean Intellectual Property Office, Applicant PCT/US2015/043861, International Search Report and Written Opinion, dated May 31, 2016, 15 pages, Korea.

*Primary Examiner* — Robert E Fuller

(57) ABSTRACT

Method and system for implementing health monitoring of downhole tool without disassembly is presented in this disclosure. Investigative equipment can be installed in an exterior housing of the downhole tool so that the investigative equipment is in communication with an interior of the downhole tool. The tool can be positioned in a functional test system so that the tool is at least partially enclosed within the functional test system, and efficiency of the tool can be determined by operating the functional test system. The investigative equipment can be utilized to perform diagnostics on a condition of an internal component on the interior of the tool, and the health of the tool can be predicted based on the determined efficiency and the diagnostics.

27 Claims, 6 Drawing Sheets

(51) Int. Cl.

| | |
|---|---|
| ***E21B 41/02*** | (2006.01) |
| ***E21B 12/00*** | (2006.01) |
| ***E21B 12/02*** | (2006.01) |
| ***E21B 41/00*** | (2006.01) |

(52) U.S. Cl.
CPC ..... *E21B 41/0085* (2013.01); *E21B 41/02* (2013.01); *E21B 44/00* (2013.01)

(56) References Cited

U.S. PATENT DOCUMENTS

| | | | |
|---|---|---|---|
| 2008/0067116 | A1 | 3/2008 | Anderson et al. |
| 2012/0084065 | A1 | 4/2012 | Zhan et al. |
| 2012/0257989 | A1 | 10/2012 | Durham et al. |
| 2013/0068024 | A1 | 3/2013 | Xu et al. |
| 2013/0179356 | A1 | 7/2013 | Pawlowski et al. |
| 2016/0084069 | A1* | 3/2016 | Camacho Cardenas ..... F04D 13/10 415/118 |

* cited by examiner

HEALTH MONITORING OF POWER GENERATION ASSEMBLY FOR DOWNHOLE APPLICATIONS

This application is a U.S. national stage patent application of International Patent Application No. PCT/US2015/043861, filed on Aug. 5, 2015, the benefit of which is claimed and the disclosure of which is incorporated herein by reference in its entirety.

TECHNICAL FIELD

The present disclosure generally relates to maintenance of downhole tools and, more particularly, to health monitoring of a power generation assembly for downhole applications.

BACKGROUND

Oil and gas wells produce oil, gas and/or byproducts from subterranean petroleum reservoirs. Various systems are utilized to drill and then extract these hydrocarbons from the wells. Since the environmental conditions within such wells are typically comparatively harsh, with high temperatures, high pressures and corrosive fluids, it is important to be able to accurately predict the effects of the environment on these systems, particularly when the systems may be subject to repetitive usage, in order to identify the appropriate maintenance schedule for a particular system before the system experiences any operational degradation.

The present disclosure is directed to a downhole turbine power generation assembly that is generally used in downhole oil and gas applications to generate power for energizing the electrical circuits that supply power to sensors and motors of drilling tools. Frequent maintenance is typically required of such a turbine power generation assembly due to formation of mud cake and wear and tear after downhole use. Since it is often difficult to assess the operational degradation of the turbine power generation assembly after a particular downhole use at a rig site, it is common to send turbine generator assemblies to a maintenance facility after each drilling operation or job or, in some cases, even prior to completing a particular downhole job in order to conduct an accurate remaining life assessment and/or for repair and maintenance. The turbine power generation assembly life assessment may also involve monitoring and recording downhole data, and applying prediction models based on the data to determine used or remaining turbine generator life. However, this approach may not fit within the parameters of a particular drilling operation.

BRIEF DESCRIPTION OF THE DRAWINGS

Various embodiments of the present disclosure will be understood from the detailed description given below and from the accompanying drawings of various embodiments of the disclosure. In the drawings, like reference numbers may indicate identical or functionally similar elements.

DETAILED DESCRIPTION

Figure 1:
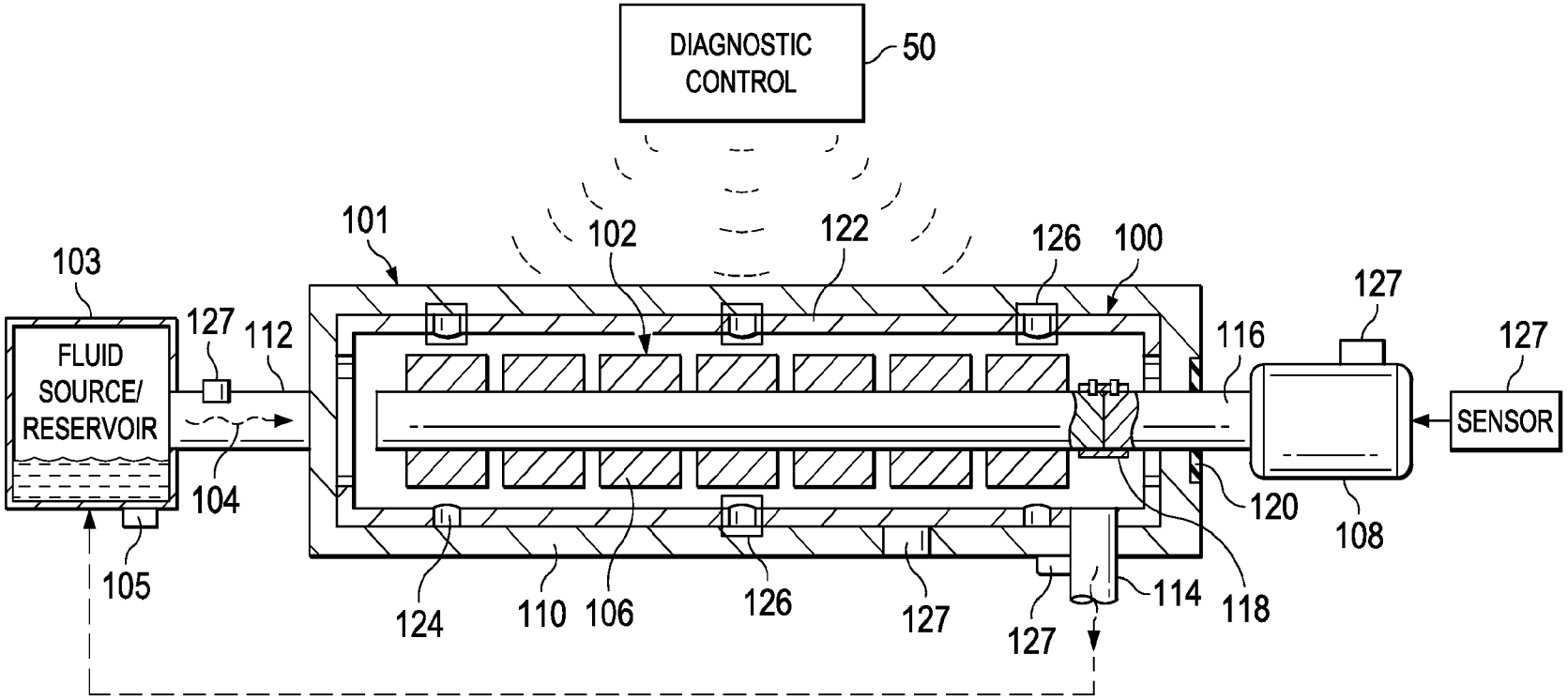
FIG. 1 shows a flowloop in which is mounted a turbine power generation assembly, according to certain illustrative embodiments of the present disclosure.

Embodiments of the present disclosure relate to health monitoring of a power generation assembly for downhole applications. While the present disclosure is described herein with reference to illustrative embodiments for particular applications, it should be understood that embodiments are not limited thereto. Other embodiments are possible, and modifications can be made to the embodiments within the spirit and scope of the teachings herein and additional fields in which the embodiments would be of significant utility.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to implement such feature, structure, or characteristic in connection with other embodiments whether or not explicitly described. It would also be apparent to one skilled in the relevant art that the embodiments, as described herein, can be implemented in many different embodiments of software, hardware, firmware, and/or the entities illustrated in the figures. Any actual software code with the specialized control of hardware to implement embodiments is not limiting of the detailed description. Thus, the operational behavior of embodiments will be described with the understanding that modifications and variations of the embodiments are possible, given the level of detail presented herein.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

Illustrative embodiments and related methods of the present disclosure are described below in reference to FIGS. 1-6 as they might be employed, for example, in a system for health monitoring of a power generation assembly in downhole applications. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments may be implemented.

The present disclosure establishes a method to perform health monitoring for oilfield systems and equipment, including Power Generation tools such as a power generation assembly, Logging While Drilling (LWD) tools and Measurement While Drilling (MWD) tools. The method presented in this disclosure also can be extended to other drilling equipment, wireline tools, production tools and other systems and equipment utilized in hydrocarbon drilling and production. In an embodiment of the present disclosure, the health monitoring method and apparatus presented herein may be applied in relation to power generation assembly (turbine power generation assembly) used for downhole oil and gas applications by enabling diagnostics of internal components without the need to tear down the assembly (whether at a rig site or at an off-site location). The approach presented herein provides the ability to adjust preventive maintenance (PM) time intervals in real time rather than performing maintenance based on pre-set PM time intervals.

The method and apparatus presented in this disclosure provide an end user the ability to determine turbine efficiency. Supporting electronic packages and software shall provide detailed analysis on predicting the operating efficiency of power generation assembly. The method and apparatus presented in this disclosure also provide real time imagery of internal components of the assembly for identifying wear and tear, which may include changes to the material and/or geometric properties without disassembly at the rig site. The ability to determine turbine efficiency and wear and tear at the rig site allows an end user to establish reusability criteria with high confidence, thereby facilitating health monitoring based maintenance rather than the use of pre-set PM interval hours.

Figure 2:
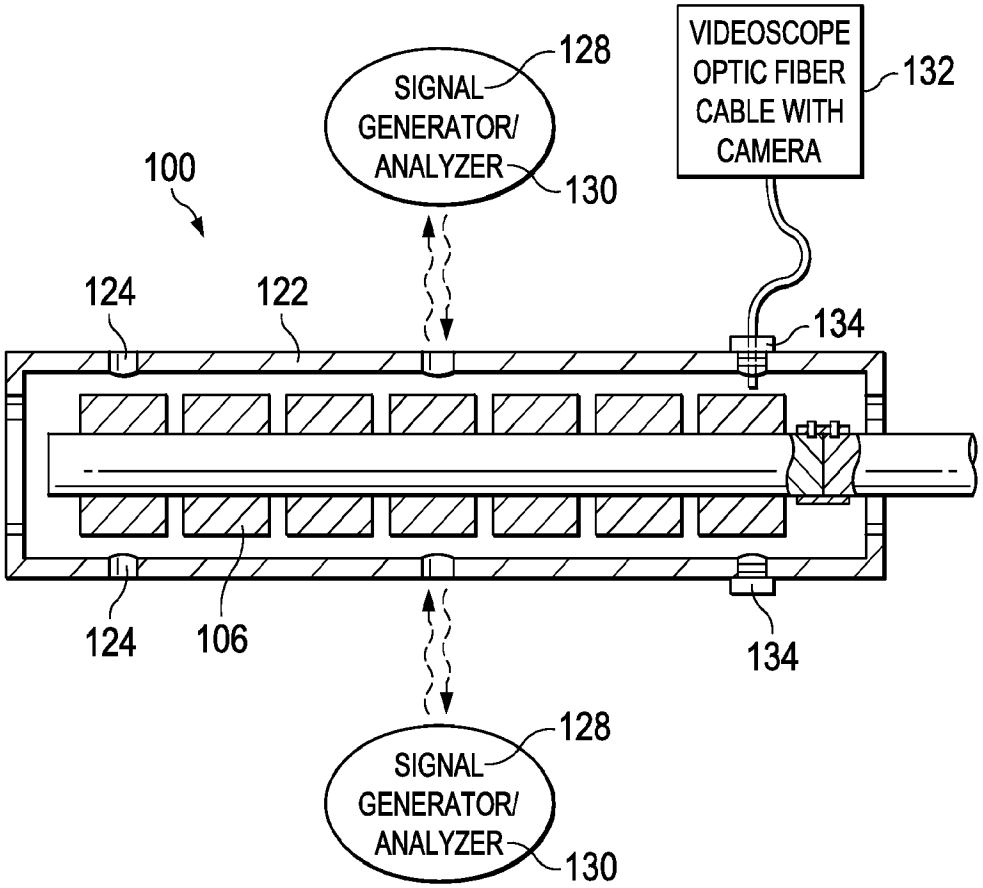
FIG. 2 shows the turbine power generation assembly of FIG. 1, according to certain illustrative embodiments of the present disclosure.

With reference to FIGS. 1 and 2, an apparatus is shown for determining operating efficiency of a turbine power generation assembly 100 and for assessing turbine wear, according to certain illustrative embodiments of the present disclosure. The method and apparatus presented herein and illustrated in FIG. 1 utilize a functional test system based on a flow loop or flush tank 101 configured to determine efficiency of a downhole tool (e.g., a turbine power generation assembly 100). In one or more embodiments, flow loop 101 may be utilized to flush components 106 of a turbine assembly 102 inside turbine power generation assembly 100 using a fluid 104 and thereafter, assess turbine operating efficiency.

Flow loop 101 in FIG. 1 may be formed of an outer hollow pressure tube 110 in which turbine power generation assembly 100 may be mounted and enclosed. Inlet and outlet fluid ports 112 and 114 respectively in the hollow tube 110 may allow the ability to flush turbine assembly 102 with the flushing fluid 104, thus facilitating removal of residual downhole drilling mud and debris before determining operating efficiency of turbine assembly 102. In one or more embodiments, the flushing fluid 104 may be water, oil, or some other transducing fluid. In certain embodiments, flow loop 101 may be utilized to perform a corrosion resistant treatment on turbine assembly 102 to avoid long term corrosion by flushing turbine assembly 102 with a corrosion resistant fluid (e.g., fluid 104).

A fluid source 103 may be coupled to inlet fluid port 112 that brings fluid 104 into flow loop 101. In one or more embodiments, a pump 105 attached to fluid source 103 may be configured to produce a sufficient amount of kinetic energy for fluid 104 that would take fluid 104 from fluid source 103 and send fluid 104 into flow loop 101 through inlet fluid port 112. In this way, fluid 104 may have enough energy to go through flow loop 101 in order to flush turbine 102 as well as to turn on turbine 102 for assessing turbine operating efficiency. In an embodiment, as illustrated in FIG. 1, pump 105 may be located external to fluid source 103. In another embodiment (not shown in FIG. 1), pump 105 may be located inside fluid source 103.

In one or more embodiments, fluid 104 may flow from outlet fluid port 114 into a drainage (not shown in FIG. 1), and fluid source 103 may provide a continuous source of fluid 104. In this case, fluid source 103, inlet fluid port 112, flow loop 101 and outlet fluid port 114 may form an open loop system, which may be suitable for offshore locations where plenty of fluid/water is available and/or when turbine power generation assembly 100 is located at a workshop location where fluid source 103 is a water tap or a water inlet. For certain other embodiments, when, for example, turbine power generation assembly 100 is located at a remote land drilling rig site where availability of fluid/water is scarce, inlet fluid port 112 may be coupled to fluid reservoir 103 instead of fluid source. In this case, fluid 104 may flow from outlet fluid port 114 into a filtration system (not shown in FIG. 1) that recycles fluid 104 and replenishes fluid reservoir 103 with filtered (recycled) fluid 104. Thus, fluid reservoir 103, inlet fluid port 112, flow loop 101 and outlet fluid port 114 of turbine power generation assembly 100 may form a portable close loop system, as illustrated in FIG. 1.

Flow loop 101 may further include an alternator/generator mechanism 108 coupled to turbine power generation assembly 100 when installed within pressure tube 110. For example, mechanism 108 may be a drive mechanism to actuate turbine 102 during one or more stages of evaluation and assessment as described herein. Alternatively, mechanism 108 may be a generator to generate electricity when turbine 102 operates under flow of fluid 104 through flow loop 101. In either case, mechanism 108 is coupled to turbine power generation assembly 100 via a drive shaft 116 using a coupling 118 and a rotary seal 120 in order to perform flow loop testing to determine turbine efficiency. In one or more embodiments, coupling 118 may be mechanical or magnetic. In one or more embodiments, operating efficiency of turbine assembly 102 may be determined by comparing a measured turbine power output to an expected turbine power output for a desired flow rate range. An acceptable difference between the expected and measured power outputs can be established and utilized to determine the turbine efficiency and reusability criteria.

The method and apparatus presented in FIG. 2 allow the ability to quantify internal wear of turbine assembly 102 within turbine power generation assembly 100. In one or more embodiments, wear of turbine assembly 102 can be determined via noninvasive characterization of internal components 106 through access ports 124 of the turbine power generation assembly 100 with or without flow loop 101 setup from FIG. 1. In one or more embodiments, internal components 106 of turbine power generation assembly 100 may be a stator/rotor assembly, the shaft, bearings or other features. Certain embodiments involve use of acoustic trans-receivers installed in access ports 124 to determine stator/rotor fin thickness changes. Furthermore, access ports 124 may be utilized as channels to obtain internal component images via a bore-scope/video-scope (e.g., optic fiber cable with camera) and compare the obtained images with pre-run images in order to identify and quantify wear. By inspecting internal components 106, changes in turbine power generation assembly 100 may be detected and assessed, such as, for example, in the thickness/shape of the shaft or fins of rotors and stators in a stator/rotor assembly 106, without disassembling turbine power generation assembly 100 at the rig site.

Referring to both FIGS. 1 and 2, turbine power generation assembly 100 generally includes a tubular mandrel or housing 122 disposed around turbine 102 within outer pressure tube 110. Housing 122 may include one or more access ports 124 extending from an exterior of the housing to an interior of the housing so as to facilitate assessment of the wear of internal components 106 of turbine power generation assembly 100 by providing a structure on which various investigative equipment 126 may be mounted for purposes of the assessment. Investigative equipment 126 may include, for example, transceivers, transducers, cameras, optic fibers, sensors and the like. In one or more embodiments, investigative equipment 126 may be a transceiver 126 that may be mounted in one or more of access ports 124; transceiver 126 may provide signals (e.g., originating from a signal generator 128) that can be analyzed (e.g., by a signal analyzer 130) to detect changes in thickness/shape of turbine components 106 after a downhole use of turbine power generation assembly 100 at the rig site.

In one or more embodiments, investigative equipment 126 may be transducers 126. When inner flow tube 122 is filled with fluid 104 in the form of a liquid such as water or oil, reflected signals (e.g., sound waves) from the liquid/component interface may be analyzed and compared to reference images in order to determine changes in component thickness. For example, the change in thickness of fins of rotors and stators 106 may be evaluated and compared to reference images. The reference images may be acquired during a last maintenance cycle or prior to a downhole use of turbine power generation assembly 100.

In other embodiments, investigative equipment 126 may be an optical fiber cable with a camera (or video scope) 132 for visual inspection. Optical images acquired at the rig site using optical fiber camera 132 may be compared with optical images obtained during the last maintenance cycle. Results from the comparison of images along with the ability to detect change in thickness/form/shape of components 106 can help assess internal wear without disassembly.

Furthermore, access ports 124 may also accommodate a quick connect coupling to flush turbine 102 with solvents to prevent the turbine 102 from long term storage corrosion. In one or more embodiments, investigative equipment 126 may be installed and remain in place during deployment and downhole operation of turbine power generation assembly 100, while in other embodiments, plugs 134 may be installed in access ports 124 during deployment and downhole operation of turbine power generation assembly 100. In either case, in one or more embodiments, investigative equipment 126 and/or plugs 134 when installed are selected to maintain the pressure rating of housing 122, and as such, may include seals, covers or similar devices to maintain pressure within or outside of housing 122 as desired.

In addition to investigative equipment 126, which as described herein, is generally utilized to assess internal components 106 of a system such as turbine 102, external sensors 127 may be mounted to gather data utilized in the assessments described herein. For example, a sensor 127 may be utilized to measure RPMs of mechanism 108 or shaft 116 or power output of mechanism 108, in cases where mechanism 108 is a generator. Likewise, external sensors 127 may be mounted on adjacent ports 112, 114 to measure flow of fluid 104. Similarly, one or more sensors 127 may be mounted inside chamber 110, but external to housing 124 to measure various environmental properties therein, such as temperature and/or pressure.

FIGS. 1 and 2 show illustrative embodiments of functional test system (such as flow loop 101) and inspection (investigative) system (such as housing 122 with access ports 124) of turbine power generation assembly 100 positioned in horizontal orientation. In other embodiments, the functional test system and the inspection system of turbine power generation assembly 100 may be in vertical position or in an angular position (not shown in FIGS. 1 and 2). In an embodiment when the functional and inspection test systems of turbine power generation assembly 100 are positioned vertically, fluid 104 may be applied to flush turbine assembly 102 in more efficient way requiring less kinetic power because of gravity pushing fluid 104 down through flow loop 101.

Finally, as shown in FIG. 1, a diagnostic computer and control system 50 may be utilized in conjunction with flow loop 101 and investigative equipment 126 and any external sensors 127 that collect data from investigative equipment 126 and any external sensors 127 to implement health monitoring based method as described in more detail below. In this regard, such data may be transmitted wirelessly or by wired communication with computer and control system 50. System 50 may include a database or memory with diagnostic data and information related to turbine power generation assembly 100 acquired from previous inspections of turbine power generation assembly 100, such as, for example, data related to efficiency, internal equipment degradation, images of rotors or stators, estimated remaining life of the turbine power generation assembly, etc.

In accordance with certain embodiments of the present disclosure, the ability to determine turbine efficiency and/or conduct a qualitative/quantitative assessment of internal components 106 of turbine power generation assembly 100 without disassembly at a rig site can help implement health monitoring based method for the turbine power generation assembly 100 rather than utilize pre-set PM interval hours.

Moreover, while flow loop 101, investigative equipment 126, external sensors and control system 50 have been described with reference to turbine power generation assembly 100, the apparatus may be used to implement health monitoring based method for any downhole equipment that is subjected to high wear and tear and requires a frequent maintenance.

Typically, in a tool operational flow for a power generation assembly based on a pre-set PM interval, tool reusability after a particular job is determined based on a pre-set or pre-determined PM interval. If a pre-set PM interval has not yet been reached following a deployment, the tool may be placed back in inventory or racked back for reuse. In contrast, if the pre-set PM interval has been reached, the tool will be sent for level 1 (L1) maintenance, which is generally preventive maintenance, and/or level 2 (L2) maintenance, which is generally corrective or repair maintenance. Of course, if the tool experienced an operational failure at any time during the previous deployment, the pre-set PM interval is overridden and the tool is pulled out of service for L1 and/or L2 maintenance as needed. Reuse of the power generation assembly dowhole may be repeated for several cycles, i.e., run downhole, until the tool either experiences a failure or the pre-set PM interval is reached.

Figure 3:
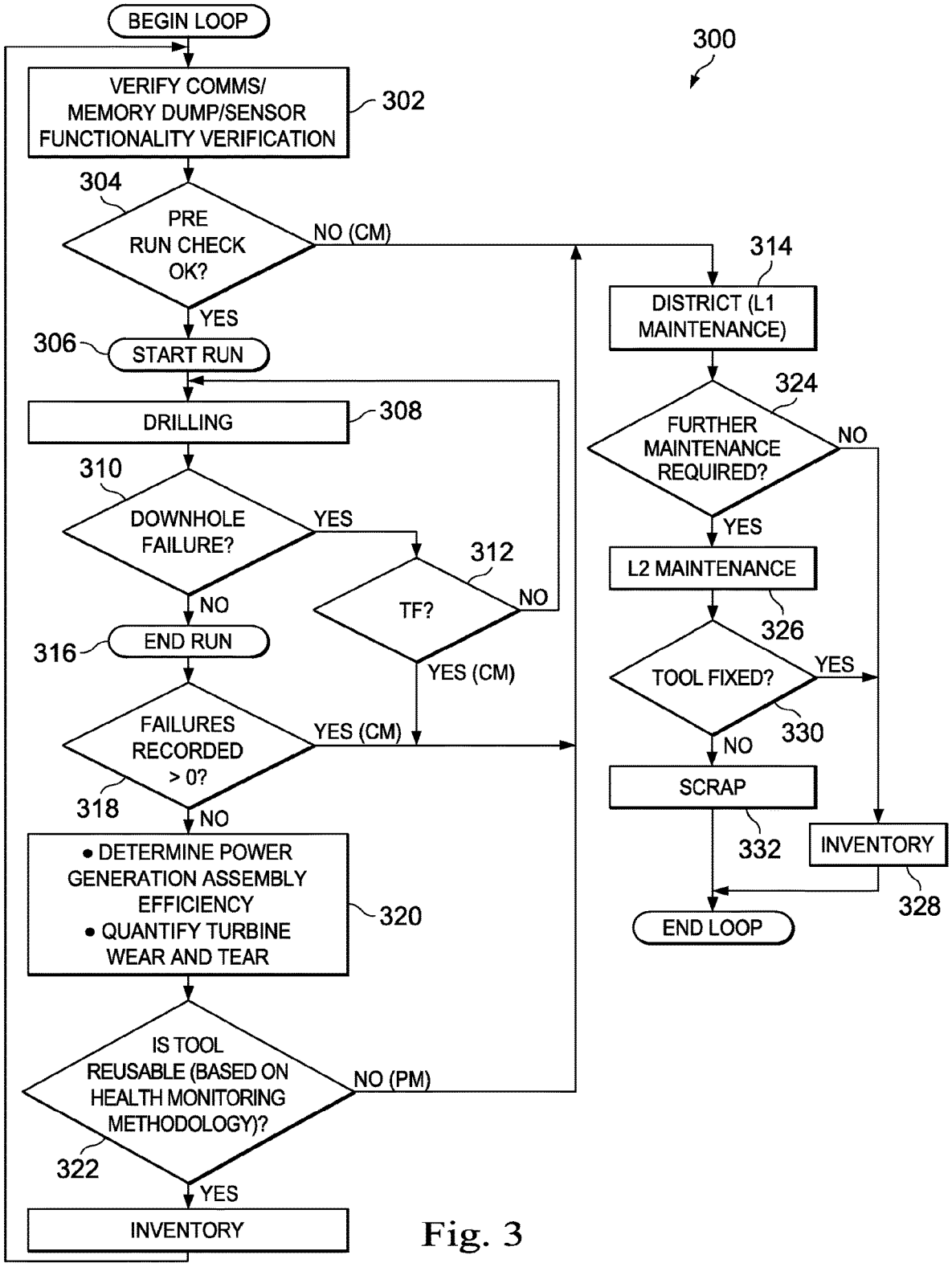
FIG. 3 shows a tool operational flow for a power generation assembly between a rig site and a repair-and-maintenance center based on a health monitoring method presented herein, according to certain illustrative embodiments of the present disclosure.

In contrast, as illustrated in FIG. 3 tool operational flow 300 for a power generation assembly based on a health monitoring system and method as disclosed herein is illustrated. Prior to any deployment, the tool comprising the power generation assembly is subjected to various pre-operation checks at block 302 to ensure that various predetermined operational parameters have been satisfied or fall within a desired range. Theses checks may include verification that communications are operating correctly, verification that sensors associated with the tool including sensors associated with the power generation assembly are operating correctly and verification of certain tool functionality, such as sensor response, usable memory capacity, polling (transmitting and receiving data) between sensors and controller, pneumatic actuation for verifying turbine rotation, and the like. In addition, data associated with or generated from the prior downhole trip may be downloaded for future use, as described below.

At block 304, a decision is made as to whether all operational parameters have been satisfied. If all operational parameters have been satisfied, at block 306, the power generation assembly is run downhole. In this regard, a working fluid, such as drilling mud, is pumped through the power generation assembly in order to generate power as is well known in the industry. In such case, at block 308, drilling is commenced and continues for a period of time.

During the drilling, the drilling system will be monitored, such as at block 310, for downhole failure. If a downhole failure occurs, the failure is analyzed at block 312 to determine if the failure would result in a trip for failure (TFF) or not. Trip for failure involves, for example, pulling a Bottom Hole Assembly (BHA) out of a hole, correcting the failure by replacing the tool/widget causing failure and tripping in the hole with modified BHA to continue drilling to atarget depth (TD). If the downhole failure is corrected in real time (e.g., by re-establishing communication after communication failure) or if drilling can be performed with reduced/compromised service (e.g., due to loss of functionality of an LWD/MWD sensor), drilling at block 308 may continue. If the downhole failure is caused by power generation assembly failure, the power generation assembly will be sent for L1 maintenance, such as at block 314. Likewise, if at block 304, one or more operational parameters have not been satisfied, the power generation assembly will be send for L1 maintenance, such as at block 314.

In any event, upon completion of drilling at block 308, at block 316 the power generation assembly is tripped out of the wellbore, and at block 318, downhole operational data for the run is analyzed to determine if there were any turbine power generation assembly failures. If any power generation assembly failure is identified from the downhole run, the power generation assembly will be sent for L1 maintenance, such as at block 314.

For the purposes of this disclosure, a power generation assembly "failure" encompasses any degradation of operation, and may include a complete loss of operation of the power generation assembly or simply an operational parameter that falls outside the scope of a preferred operational range. For example, power output may be outside of (e.g., lower than) a predetermined range, which could be indicative of internal components wear of the assembly 100. In this case, while the power generation assembly continued to operate while downhole, for purposes of the tool evaluation, this depleted power output would be recorded as a failure.

If no power generation assembly failures occurred during a downhole run, at block 320, the tool efficiency (e.g., power generation assembly efficiency) may be determined and turbine wear may be quantified in accordance with the health monitoring based method described herein using the apparatus described in relation to FIGS. 1 and 2. Thereafter, at block 322, based on the results of the health monitoring analysis, the reusability of the tool can be determined. If the tool is reusable in accordance with the presented health monitoring method, the power generation assembly may be returned to inventory/racked back and the tool flow 300 may be repeated beginning at block 302. If the tool is not reusable in accordance with the health monitoring method presented in this disclosure, the tool may be sent for L1 maintenance at block 314.

In one or more embodiments of the present disclosure, rather than performing immediate maintenance in response to determination of tool operating efficiency based on the health monitoring method presented herein, a mission for the tool may be selected that will minimize the need for maintenance at the time the health monitoring operational flow 300 is performed. For example, a tool may be selected for a task based on the determined tool operating efficiency and qualitative/quantitative assessment of internal wear and tear without disassembly so that the tool, even with additional wear and tear due to operation of the tool during the new task, will not fail. In other words, the particular task or mission for which a tool may be deployed may be selected based on the determined tool operating efficiency and qualitative/quantitative assessment of internal wear and tear without disassembly in order to minimize the time the tool is "down" for maintenance.

Thus, it will be appreciated at block 322 that "reusability" may be defined based on a particular intended use. Thus, at block 322, multiple jobs or inventories may be identified, wherein each job or inventory may be represented by a different set of operational parameters. For example, a first job or first inventory for a particular job may require a tool with at least 100 hours of operational life prior to maintenance whereas a second job or second inventory for a particular job may require a tool with at least 300 hours of operational life prior to maintenance. Having determined at block 320 that a power generation assembly has approximately 150 hours of operation life remaining prior to maintenance, at block 322, the power generation assembly may be assigned to the first job or first job inventory. If, on the other hand, it is determined that no job or inventory for which the tool could be used exists, i.e., all jobs or inventories require a tool with more than 150 hours of operation life remaining prior to maintenance, the tool may be sent for L1 maintenance at block 314.

As illustrated in FIG. 3, L1 maintenance at block 314 may be followed by several additional operations. If further maintenance is required (e.g., determined at decision block 324), the tool (e.g., the turbine power generation assembly) may be sent for a level 2 (L2) maintenance, such as L2 maintenance at block 326. If further maintenance after L1 maintenance is not required, the tool may be placed in an inventory at block 328 ready to be shipped to a rig site. In the case when L2 maintenance is performed at block 326, if the tool is fixed (e.g., determined at decision block 330), the tool may be placed in the inventory at block 328 ready to be shipped to the rig site. If the tool cannot be fixed after L2 maintenance at block 326, the tool may be scrapped, at block 332.

Figure 4:
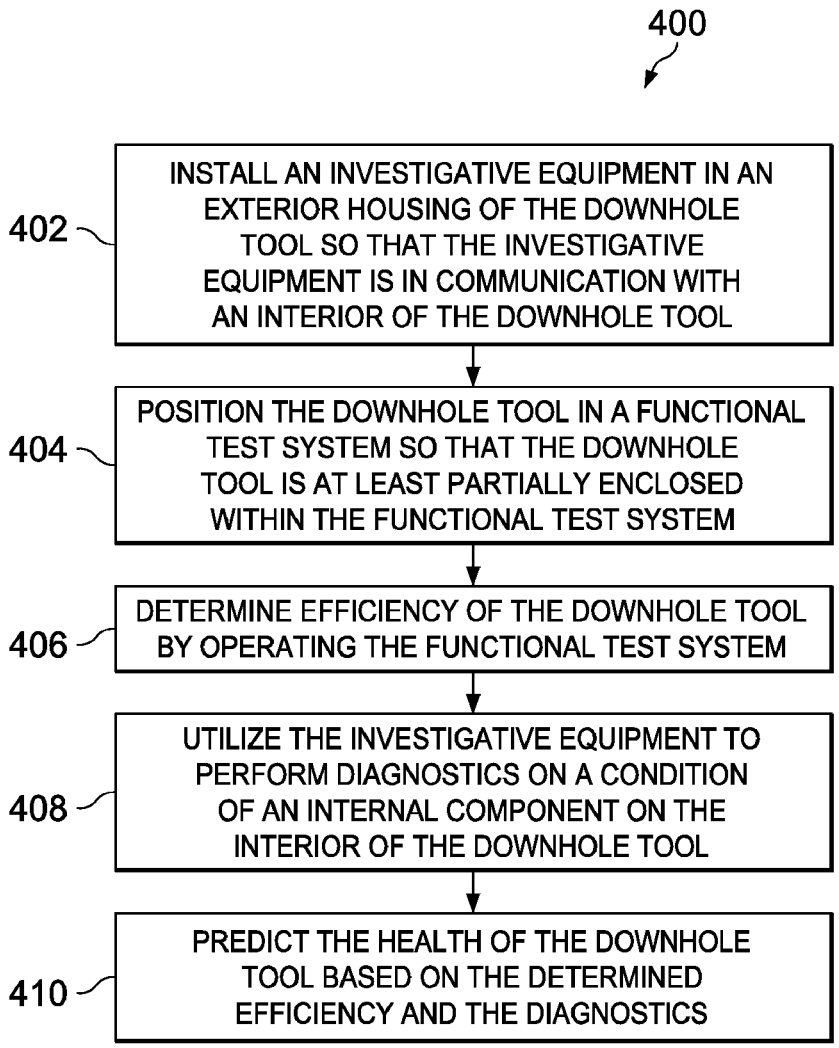
FIG. 4 is a flow chart illustration of a method for determining turbine power generation assembly efficiency and assessing turbine wear and tear at a rig site, according to certain illustrative embodiments of the present disclosure.

FIG. 4 is a flowchart of an illustrative method 400 for determining turbine power generation assembly efficiency and assessing turbine wear, according to certain illustrative embodiments of the present disclosure. Operations of the method 400 represents operations of block 320 of FIG. 3 in the above described tool operational flow.

The method 400 begins at 402, where investigative equipment is installed in the housing of a tool so as to be in communication with the interior of the tool. For example, in a turbine power generation assembly, investigative equipment may be installed in one or more ports positioned in the outer tubular body of turbine power generation assembly. The ports permit the investigative equipment to access the interior of the turbine power generation assembly and in particular, the internal components thereof, such as the stator and rotor fins. The investigative equipment may include, but is not limited to transceivers, transducers, cameras, optic fibers, sensors. It should be noted that the investigative equipment may be installed before a tool is put into service. Thus, the investigative equipment may be installed prior to downhole deployment of a turbine power generation assembly. Alternatively, the turbine power generation assembly may be outfitted with the investigative equipment once the turbine power generation assembly is retrieved from the wellbore.

At 404, the tool is positioned in a functional test system, such as flow loop 101 described above and illustrated in FIG. 1. Preferably, the tool, such as the turbine power generation assembly, is sealed or otherwise enclosed within the functional test system. The turbine power generation assembly may be engaged by a power input or output mechanism operable during the functionality assessment. For example, the power mechanism may be a drive mechanism to actuate the turbine during one or more stages of evaluation and assessment as described herein. Alternatively, power mechanism may be a generator to generate electricity when the turbine operates under flow of a fluid through a flow loop. The power mechanism may be coupled to the turbine power generation assembly via a sealed drive shaft.

At 406, a flushing fluid is introduced into the functional test system. Preferably, the functional test system includes at least two spaced apart ports so that the flushing fluid can be passed through the tool in order to flush any debris that may be caked or entrapped in the tool. In one or more embodiments, the flushing fluid may also be used to operate the tool. Specifically, the flushing fluid may be used to turn the rotor of the turbine power generation assembly, much in the way that a drilling fluid is used to turn the rotor during downhole operation.

At 408, diagnostics are performed on the turbine power generation assembly. These diagnostics may be performed by computer and control system 50 identified above in FIG. 1. These diagnostics may include analysis of the internal components of the turbine power generation assembly utilizing the investigative equipment. For example, a transceiver may provide signals (e.g., originating from a signal generator) that can be analyzed (e.g., by a signal analyzer 130) to detect changes in thickness/shape of turbine. In one or more embodiments, the investigative equipment may be transducers that propagate investigative waves, such as sound waves, through the fluid in the turbine power generation assembly. The signals are reflected from the liquid/component interface and utilized to generate a waveform/image. The waveform/image can be compared to reference waveforms/images, i.e., waveforms/images acquired in previous tool flows 300, in order to determine changes in component thickness, such as the change in thickness of fins of the rotors and stators. Similarly, optical images can be acquired using an optical fiber camera and these images may be compared with previously obtained optical images, such as images obtained during the last maintenance cycle. Results from the comparison of optical images along with the ability to detect change in thickness/form/shape of components can help assess internal wear without disassembly.

At 408, diagnostics can also be performed using sensors mounted externally of the turbine housing. For example, RPMs of the turbine may be assessed as fluid is flowed through the flow loop. Likewise, voltage of an attached generator may be assessed in relation to the fluid flow.

Finally, at 410, the remaining useful life of the tool and operating efficiency may be predicted. In one or more embodiments, the prediction may be based on the expected changes the internal components may undergo in a next cycle of downhole usage based on comparison of changes that resulted and were observed, using the foregoing diagnostics, from previous cycles.

The method and apparatus presented in this disclosure may enable a determination of internal wear without disassembly, measuring turbine efficiency, and determining reusability after downhole use with high degree of confidence. Implementation of the health monitoring based maintenance method instead of pre-set PM maintenance time intervals may also save logistic and repair/maintenance costs, improve asset utilization, provide non-disruptive service, and potentially improve reliability by reducing tear downs and assembly errors during rebuild.

It is understood that any specific order or hierarchy of operations in the processes disclosed is an illustration of exemplary approaches. Based upon design preferences, it is understood that the specific order or hierarchy of operations in the processes may be rearranged, or that all illustrated operations be performed. Some of the operations may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Furthermore, the illustrative methods described herein may be implemented by a system including processing circuitry or a computer program product including instructions which, when executed by at least one processor, causes the processor to perform any of the methods described herein.

Figure 5:
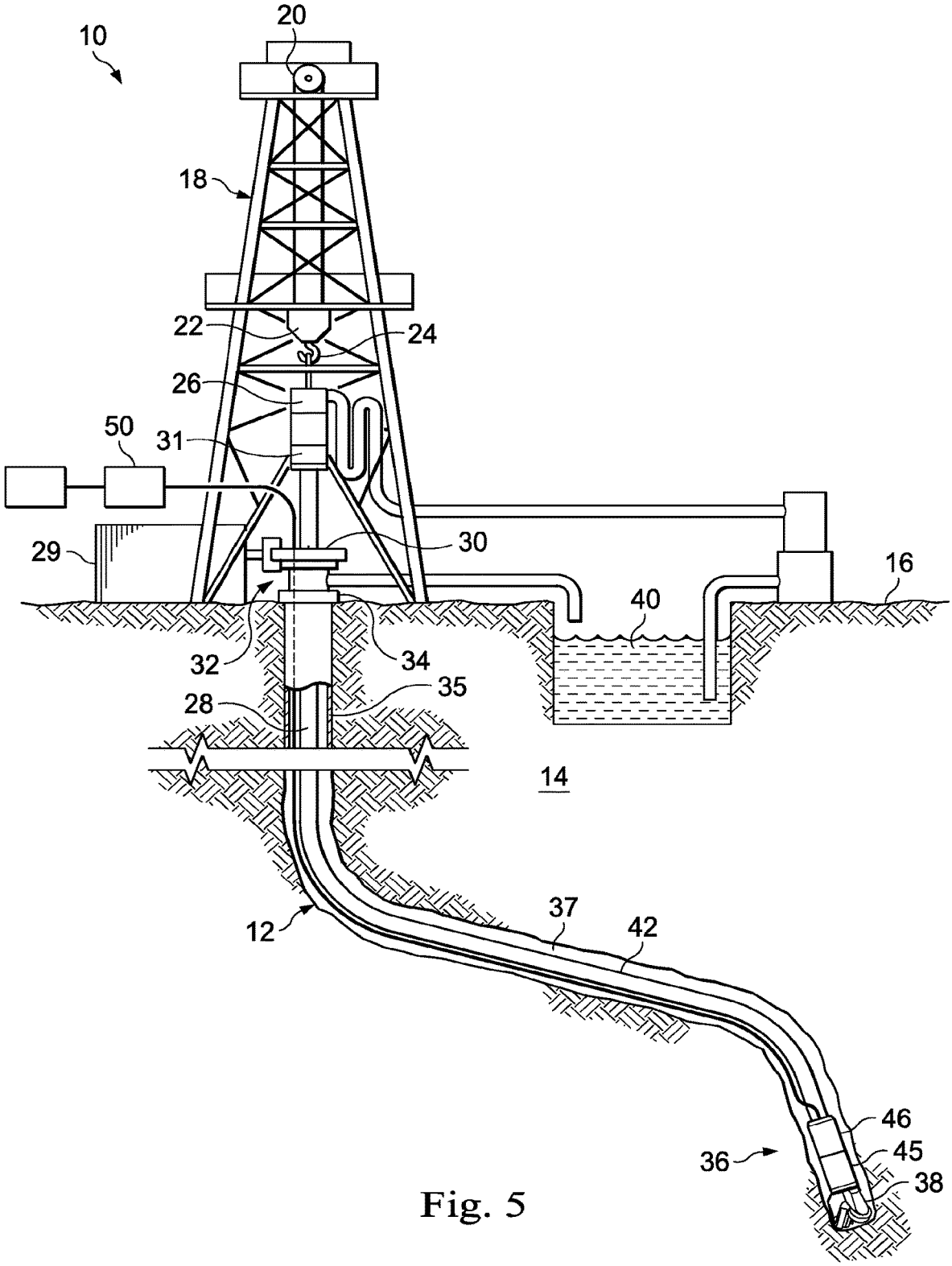
FIG. 5 illustrates a land-based drilling system in which the health monitoring method may be used, according to certain embodiments of the present disclosure.
Figure 6:
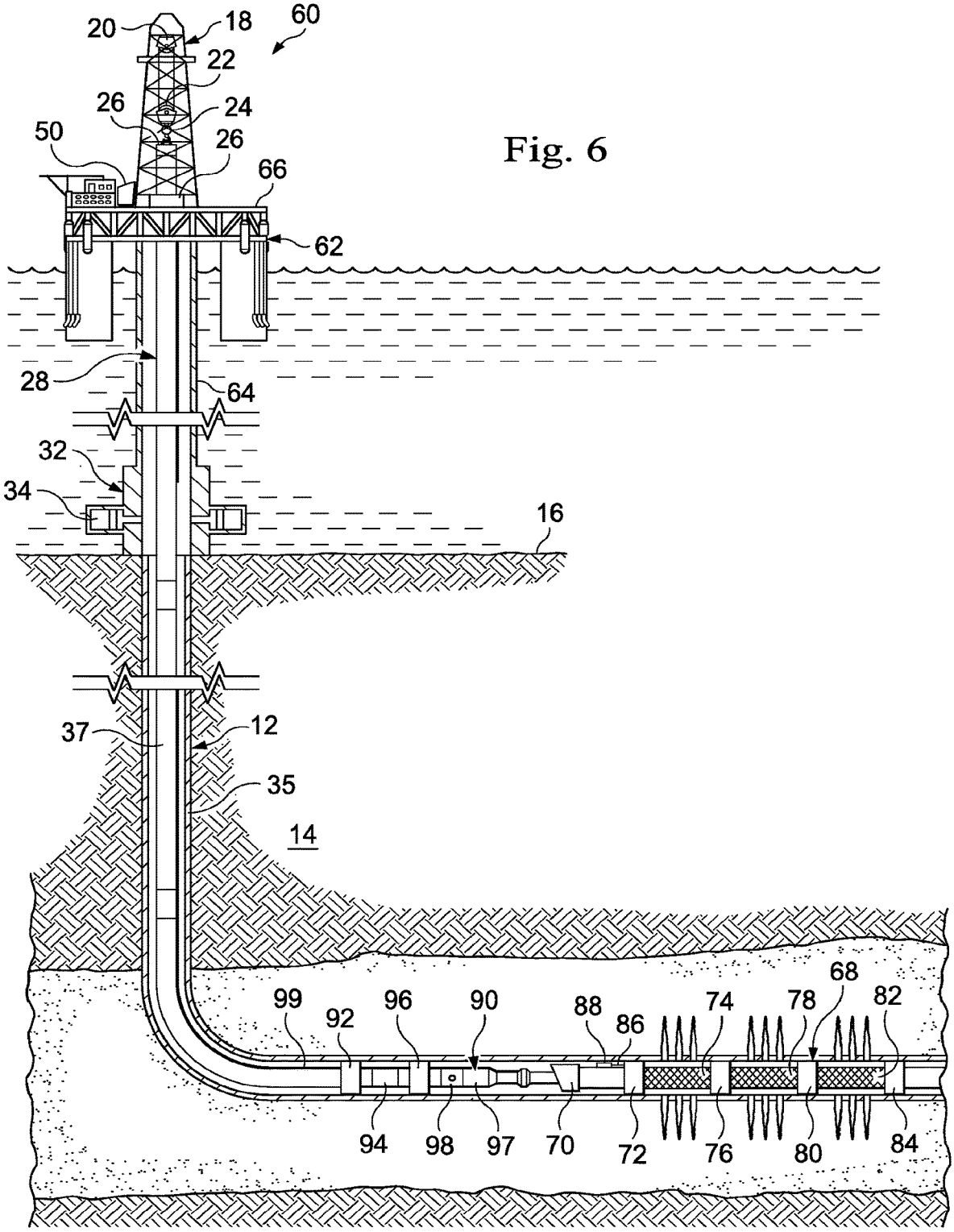
FIG. 6 illustrates a marine production system in which the health monitoring method may be used, according to certain embodiments of the present disclosure.

As described above, embodiments of the present disclosure are particularly useful for health monitoring of various drilling, wireline and production tools and equipment used in drilling and production systems such as those illustrated in FIGS. 5 and 6.

FIG. 5 is an elevation view in partial cross-section of a drilling and production system 10 utilized to recover hydrocarbons from a wellbore 12 extending through various earth strata in an oil and gas formation 14 located below the earth's surface 16. Drilling and production system 10 may include a drilling rig 18, such as the land drilling rig shown in FIG. 5. Drilling rig 18 may include a hoisting apparatus 20, a travel block 22, a hook 24 and a swivel 26 or similar mechanisms for raising and lowering various conveyance vehicles 28, such as pipe string, coiled tubing, wireline, slickline, and the like. In the illustration, conveyance vehicle 28 is a substantially tubular, axially extending drill string. Likewise, drilling rig 12 may include rotary table 30, rotary drive motor 29, and other equipment associated with rotation and/or translation of tubing string 28 within a wellbore 12. For some applications, drilling rig 18 may also include a top drive unit 31. Although drilling system 10 is illustrated as being a land-based system, drilling system 10 may be deployed on offshore platforms, semi-submersibles, drill ships, and the like.

Drilling rig 18 may be located proximate to or spaced apart from a well head 32, such as in the case of an offshore arrangement (not shown). One or more pressure control devices 34, such as blowout preventers and other equipment associated with drilling or producing a wellbore may also be provided at well head 32.

Wellbore 12 may include a casing string 35 cemented therein. Annulus 37 is formed between the exterior of tubing string 28 and the inside wall of wellbore 12 or casing string 35, as the case may be.

The lower end of drill string 28 may include bottom hole assembly 36, which may carry at a distal end a rotary drill bit 38. Drilling fluid 40 may be pumped to the upper end of drill string 28 and flow through the longitudinal interior 42 of drill string 28, through bottom hole assembly 36, and exit from nozzles formed in rotary drill bit 38. At bottom end 44 of wellbore 12, drilling fluid 40 may mix with formation cuttings, formation fluids and other downhole fluids and debris. The drilling fluid mixture may then flow upwardly through annulus 37 to return formation cuttings and other downhole debris to the surface 16. Bottom hole assembly 36 may include a downhole mud motor 45. Bottom hole assembly 36 and/or drill string 28 may also include various other tools 46 including MWD, LWD instruments, detectors, circuits, or other equipment that provide information about wellbore 12 and/or formation 14, such as logging or measurement data from wellbore 12. Measurement data and other information may be communicated using electrical signals, acoustic signals or other telemetry that can be converted to electrical signals at the well surface to, among other things, monitor the performance of drilling string 28, bottom hole assembly 36, and associated rotary drill bit 32, as well as monitor the conditions of the environment to which the bottom hole assembly 36 is subjected.

Bottom hole assembly 36 may further include a downhole assembly such as turbine power generation assembly 100 illustrated in FIG. 1. As discussed, the health monitoring method and apparatus presented herein in relation to turbine power generation assembly 100 from FIG. 1 may provide a user with real time imagery of internal components of the assembly to clearly identify wear and tear, which may relate to changes to the material and/or geometric properties without disassembly at a rig site and the ability to determine reusability with high confidence, thereby facilitating the health monitoring based maintenance rather than the use of pre-set preventive maintenance interval hours.

Shown deployed in association with drilling and production system 10 is a computer system 50 adapted for implementing, for example, a condition based maintenance (CBM) program. For example, during a drilling procedure, the environment in which drill bit 38 is operated, and additionally or alternatively, the actual condition of drill bit 38 may be monitored and utilized by computer system 50 to determine a maintenance program for drill bit 38 using the health monitoring based maintenance method described herein. Thus, drill bit 38 may be deployed and utilized in wellbore 12 for drilling operations. The conditions under which it is operated are measured. Prior to re-deploying drill bit 38, the health monitoring based maintenance method may be utilized to determine whether it is necessary to subject drill bit 38 to maintenance prior to additional deployments. Further, computer system 50 may support various electronic packages and software to provide a user with a detailed analysis on predicting operating efficiency of bottom hole assembly 36 including turbine power generation assembly 100 from FIGS. 1 and 2 without disassembly of equipment.

Likewise, FIG. 6 is an elevation view in partial cross-section of a drilling and production system 60 utilized to recover hydrocarbons from a wellbore 12 extending through various earth strata in an oil and gas formation 14 located below the earth's surface 16. Drilling and production system 60 may include a drilling rig 18 which may be mounted on an oil or gas platform 62, such as illustrated in the offshore platform shown in FIG. 6. Drilling rig 18 may include a hoisting apparatus 20, a travel block 22, a hook 24 and a swivel 26 or similar mechanisms for raising and lowering various conveyance vehicles 28, such as pipe string, coiled tubing, wireline, slickline, and the like. In the illustration, conveyance vehicle 28 is a substantially tubular, axially extending production string. Although system 10 is illustrated as being a marine-based system, system 10 may be deployed on land. For offshore operations, whether drilling or production, subsea conduit 64 extends from deck 66 of platform 62 to a subsea wellhead installation 32, including pressure control devices 34. Tubing string 28 extends down from drilling rig 18, through subsea conduit 64 and into wellbore 12.

Drilling rig 18 may be located proximate to or spaced apart from a well head 32, such as in the case of an offshore arrangement. One or more pressure control devices 34, such as blowout preventers and other equipment associated with drilling or producing a wellbore may also be provided at well head 32.

Wellbore 12 may include a casing string 35 cemented therein. Annulus 37 is formed between the exterior of tubing string 28 and the inside wall of wellbore 12 or casing string 35, as the case may be.

Disposed in a substantially horizontal portion of wellbore 12 is a lower completion assembly 68 that includes various tools such as an orientation and alignment subassembly 70, a packer 72, a sand control screen assembly 74, a packer 76, a sand control screen assembly 78, a packer 80, a sand control screen assembly 82 and a packer 84.

Extending downhole from lower completion assembly 68 is one or more communication cables 86, such as a sensor or electric cable, that passes through packers 72, 76 and 80 and is operably associated with one or more electrical devices 88 associated with lower completion assembly 68, such as sensors position adjacent sand control screen assemblies 74, 78, 82 or at the sand face of formation 14, or downhole controllers or actuators used to operate downhole tools or fluid flow control devices. Cable 86 may operate as communication media, to transmit power, or data and the like between lower completion assembly 68 and an upper completion assembly 90.

In this regard, disposed in wellbore 12 at the lower end of tubing string 28 is an upper completion assembly 90 that includes various tools such as a packer 92, an expansion joint 94, a packer 96, a fluid flow control module 98 and an anchor assembly 97.

Extending uphole from upper completion assembly 90 are one or more communication cables 99, such as a sensor cable or an electric cable, which passes through packers 92, 96 and extends to the surface 16 in annulus 34. Cable 99 may operate as communication media, to transmit power, or data and the like between a surface controller (not pictured) and the upper and lower completion assemblies 90, 68.

Upper and/or lower completion assemblies 90, 68 may further comprise turbine power generation assembly adapted to include access ports to facilitate in assessing the wear and tear of internal components, as described herein and illustrated in FIGS. 1 and 2. For example, during a completion procedure, the environment in lower completion assembly 68 and upper completion assembly 90 is operated, and additionally or alternatively, the actual condition of lower completion assembly 68 and/or upper completion assembly 90 may be monitored as described herein to determine internal wear and tear without disassembly at a rig site thereby facilitating health monitoring based maintenance for lower completion assembly 68 and/or upper completion assembly 90 or any part thereof.

Shown deployed in association with drilling and production system 10 is computer system 50 adapted for implementing the health monitoring based maintenance method described herein. For example, during a completion procedure, the environment in lower completion assembly 68 and upper completion assembly 90 is operated, and additionally or alternatively, the actual condition of lower completion assembly 68 and/or upper completion assembly 90 may be monitored and utilized by computer system 50 to determine a maintenance program for lower completion assembly 68 and/or upper completion assembly 90 or any part thereof. In this regard, the health monitoring based maintenance method may be implemented with respect to an entire system, such as lower completion assembly 68 and/or upper completion assembly 90, or individual components or tools that comprise the system, such as a packer, sand control screen assembly, fluid control module, anchor assembly or the like, and a determination can be made once this equipment is retrieved from a wellbore, whether maintenance is necessary. Computer system 50 may support various electronic packages and software to provide a user with a detailed analysis on predicting operating efficiency of upper and/or lower completion assemblies 90, 68 including turbine power generation assembly 100 from FIG. 1 without disassembly at a rig site.

A method of health monitoring of a downhole tool has been described and may generally include: installing an investigative equipment in an exterior housing of the downhole tool so that the investigative equipment is in communication with an interior of the downhole tool; positioning the downhole tool in a functional test system so that the downhole tool is at least partially enclosed within the functional test system; determining efficiency of the downhole tool by operating the functional test system; utilizing the investigative equipment to perform diagnostics on a condition of an internal component on the interior of the downhole tool; and predicting the health of the downhole tool based on the determined efficiency and the diagnostics. Further, the method for health monitoring of downhole assembly may also include: accessing, via one or more access ports of a flow tube assembly of a turbine, a plurality of internal components of a turbine generator assembly, wherein the turbine generator assembly is formed by coupling the turbine to a generator assembly; performing, without disassembling the turbine generator assembly, diagnostics of the internal components of the turbine generator assembly based on the accessing the internal components via the one or more access ports; and providing, via a user interface, a user with an analysis on predicting operating efficiency of the turbine generator assembly based on the diagnostics of the internal components.

For the foregoing embodiments, the method may include any one of the following operations, alone or in combination with each other: Driving a fluid through the functional test system to flush the downhole tool prior to determining the efficiency of the downhole tool; Determining efficiency of the downhole tool is based on a power output generated by the downhole tool when operating the functional test system; Utilizing the investigative equipment comprises measuring a feature of the internal component of the downhole tool and making a determination as to the wear of the downhole tool based on differences between the currently measured feature and a previous condition of the feature; Utilizing the investigative equipment comprises generating an image of a feature of the internal component and comparing the currently generated image to a previously generated image of the feature; Predicting the remaining useful life of the downhole tool; Identifying a plurality of possible deployments for the downhole tool and selecting a particular deployment that will not exceed the predicted remaining useful life of the downhole tool; Utilizing the investigative equipment comprises generating a signal with a transceiver and acquiring one or more waveforms to detect changes in thickness/shape of the internal component; Utilizing the investigative equipment comprises propagating a sound wave with a transducer through a fluid to a liquid/component interface and utilizing the sound wave to generate at least one of waveforms or an image; Coupling the downhole tool to a power input or output mechanism of the functional test system; Utilizing the power input or output mechanism to operate the downhole tool to determine the efficiency of the downhole tool; Encapsulating the turbine generator assembly is in a tube with a pre-determined pressure rating; Flushing, via inlet and outlet fluid ports of the tube, the turbine with a transducing fluid to facilitate the diagnostics of the internal components; Interfacing one or more transceivers with the one or more access ports; Transmitting one or more transmitting signals from the one or more transceivers through the one or more access ports to the internal components; Receiving one or more receiving signals, generated based on the one or more transmitting signals, by the one or more transceivers through the one or more access ports; Performing the diagnostics of the internal components based on the one or more receiving signals; Performing visual inspection of the internal components through the one or more access ports by using one or more video devices interfaced with the one or more access ports;

The possible deployments have at least one differing environmental characteristic, the environmental characteristics selected from the group consisting of pressure, temperature, depth, intended rate of penetration, formation type, and length of deployment.

Likewise, a system for health monitoring of a downhole assembly has been described and includes: an inspection system comprised of a housing; a functional test system comprised of an enclosure with an inlet and an outlet; a source of a fluid in communication with the inlet of the functional test system; a downhole tool enclosed within the functional test system, wherein the downhole tool includes an exterior and an interior with at least one internal component within the interior; and investigative equipment of the inspection system mounted on the exterior of the downhole tool and in communication with the interior.

For any of the foregoing embodiments, the system may include any one of the following elements, alone or in combination with each other: a diagnostic system in communication with the investigative equipment; the functional test system is a flow loop formed of an outer hollow pressure tube; the housing of the inspection system comprises at least one access port extending from the exterior to the interior of the downhole tool and in which the investigative equipment is mounted; a plurality of access ports, each carrying investigative equipment; the investigative equipment comprises at least one of transceivers, transducers, cameras, optic fibers or sensors; the investigative equipment comprises one or more video devices configured for visual inspection of the at least one internal component through the at least one access port extending from the exterior to the interior of the downhole tool and in which the investigative equipment is mounted; a pump attached to the source of the fluid configured to dispose the fluid from the source into the enclosure of the functional test system; the fluid is selected from the group consisting of water and oil; at least one sensor mounted externally of the downhole tool; the downhole tool is a turbine generator assembly comprising a shaft, a plurality of rotors and a plurality of stators disposed within a tubular mandrel; the functional test system further comprises a power input or output mechanism coupled to the downhole tool; the power mechanism is a generator or an alternator positioned outside the enclosure and coupled to a drive shaft of the downhole tool; the downhole tool is selected from the group consisting of a power generation assembly, a drill bit, a logging while drilling tool, a measurement while drilling tool and other drilling tools; the functional test system and the inspection system are in vertical position, horizontal position, or in angular position; the functional test system and the inspection system are located at a well site; the functional test system is utilized for predictive maintenance of the downhole tool at the well site; the source of the fluid is configured as a fluid reservoir; the fluid reservoir and the functional test system form a close-loop system where the fluid from the outlet is filtered and flows back into the fluid reservoir.

As used herein, the term "determining" encompasses a wide variety of actions. For example, "determining" may include calculating, computing, processing, deriving, investigating, looking up (e.g., looking up in a table, a database or another data structure), ascertaining and the like. Also, "determining" may include receiving (e.g., receiving information), accessing (e.g., accessing data in a memory) and the like. Also, "determining" may include resolving, selecting, choosing, establishing and the like.

As used herein, a phrase referring to "at least one of" a list of items refers to any combination of those items, including single members. As an example, "at least one of: a, b, or c" is intended to cover: a, b, c, a-b, a-c, b-c, and a-b-c.

As described above, embodiments of the present disclosure are particularly useful for implementing health monitoring based maintenance instead of performing maintenance based on pre-set PM time intervals. Advantages of the present disclosure include, but are not limited to, achieving savings on logistic and repair and maintenance cost, improvement of asset utilization, providing non-disruptive service and improving reliability by reducing tear downs and assembly errors during rebuild.

Additionally, the flowchart and block diagrams in the figures illustrate the architecture, functionality, and operation of possible implementations of systems, methods and computer program products according to various embodiments of the present disclosure. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The above specific example embodiments are not intended to limit the scope of the claims. The example embodiments may be modified by including, excluding, or combining one or more features or functions described in the disclosure.

What is claimed is:

1. A system for health monitoring of a downhole assembly, the system comprising:

a functional test system comprised of an enclosure with an inlet and an outlet;

a source of a fluid coupled to the inlet of the functional test system;

a downhole tool within the enclosure of the functional test system, wherein the downhole tool includes at least one internal component and a housing with at least one access port for providing access to an interior of the downhole tool for investigative equipment located exterior to the housing, and the functional test system is used to actuate the at least one internal component of the downhole tool as fluid flows from the source into the enclosure via the inlet; and a diagnostic system communicatively coupled to the investigative equipment to determine an operating efficiency of the downhole tool based on data collected by the investigative equipment via the at least one access port of the housing when the at least one internal component of the downhole tool is actuated by the functional test system.

2. The system of claim 1, wherein the diagnostic system is a diagnostic computer and control system in communication with the investigative equipment via one or more communication cables.

3. The system of claim 1, wherein the enclosure of the functional test system is formed of an outer hollow pressure tube.

4. The system of claim 1, wherein one or more sensors are mounted within the enclosure of the functional test system external to the housing of the downhole tool.

5. The system of claim 4, wherein measurements from the one or more sensors are used by the diagnostic system in conjunction with the data from the investigative equipment to monitor the condition of the at least one internal component of the downhole tool.

6. The system of claim 1, wherein the investigative equipment comprises at least one of transceivers, transducers, cameras, optic fibers or sensors.

7. The system of claim 1, further comprising a pump attached to the source of the fluid configured to dispose the fluid from the source into the enclosure of the functional test system.

8. The system of claim 1, further comprising at least one sensor mounted externally of the downhole tool.

9. The system of claim 1, wherein the downhole tool is a turbine power generation assembly, and the at least one internal component is a turbine assembly comprising a shaft, a plurality of rotors, and a plurality of stators disposed within the housing.

10. The system of claim 1, wherein the functional test system further comprises a power mechanism coupled to the downhole tool.

11. The system of claim 10, wherein the power mechanism is a generator or an alternator positioned outside the enclosure and coupled to a drive shaft of the downhole tool.

12. The system of claim 1, wherein the downhole tool is selected from the group consisting of a power generation assembly, a bottom hole assembly carrying a drill bit, a logging while drilling tool, a measurement while drilling tool and other drilling tools.

13. The system of claim 1, wherein a position of the downhole tool within the functional test system is changeable from a first position to one of a plurality of second positions.

14. The system of claim 1, wherein the downhole tool, the functional test system, and the diagnostic system are located at a well site.

15. The system of claim 14, wherein the functional test system is utilized for predictive maintenance of the downhole tool at the well site.

16. The system of claim 1, wherein:

the source of the fluid is configured as a fluid reservoir; and the fluid reservoir and the functional test system form a closed-loop system where the fluid from the outlet of the functional test system is filtered and flows back into the fluid reservoir.

17. A method of health monitoring of a downhole tool, the method comprising:

positioning the downhole tool in an enclosure of a functional test system so that the downhole tool is at least partially enclosed within the functional test system, wherein:

the enclosure of the functional test system includes an inlet and an outlet;

a fluid reservoir is coupled to the inlet of the enclosure;

the downhole tool includes an internal component and a housing with at least one access port for providing access to an interior of the downhole tool for investigative equipment located exterior to the housing; and the functional test system is used to actuate the internal component of the downhole tool as fluid flows from the fluid reservoir into the enclosure via the inlet;

determining efficiency of the downhole tool by operating the functional test system;

utilizing the investigative equipment to perform diagnostics on a condition of the internal component within the interior of the downhole tool; and predicting the health of the downhole tool based on the determined efficiency and the diagnostics.

18. The method of claim 17, further comprising:

driving the fluid through the functional test system to flush the downhole tool prior to determining the efficiency of the downhole tool.

19. The method of claim 17, wherein determining efficiency of the downhole tool is based on a power output generated by the downhole tool when operating the functional test system.

20. The method of claim 17, wherein utilizing the investigative equipment comprises measuring a feature of the internal component of the downhole tool and making a determination as to the wear of the downhole tool based on differences between the currently measured feature and a previous condition of the feature.

21. The method of claim 17, wherein utilizing the investigative equipment comprises generating an image of a feature of the internal component and comparing the currently generated image to a previously generated image of the feature.

22. The method of claim 17, wherein utilizing the investigative equipment comprises generating a signal with a transceiver and acquiring one or more waveforms to detect changes in thickness/shape of the internal component.

23. The method of claim 17, wherein utilizing the investigative equipment comprises propagating a sound wave with a transducer through the fluid to a liquid/component interface and utilizing the sound wave to generate at least one of waveforms or an image.

24. The method of claim 17, further comprising coupling the downhole tool to a power input or output mechanism of the functional test system.

25. The method of claim 24, further comprising utilizing the power input or output mechanism to operate the downhole tool to determine the efficiency of the downhole tool.

26. The method of claim 17, further comprising performing a corrosion resistant treatment on the downhole tool using the functional test system.

27. The method of claim 26, wherein performing the corrosion resistant treatment comprises flushing the downhole tool with a corrosion resistant fluid using the functional test system.

* * * * *